United States Patent [19]

Audeh et al.

[11] Patent Number: 4,501,651

[45] Date of Patent: Feb. 26, 1985

[54] PROCESS FOR TREATING OIL SHALE WITH A MILD OXIDANT

[76] Inventors: Costandi A. Audeh, 694 Prospect Ave., Princeton, N.J. 08540; Joseph J. Dickert, Jr., 17 S. Homestead Dr., Yardley, Pa. 19067

[21] Appl. No.: 490,904

[22] Filed: May 2, 1983

[51] Int. Cl.[3] ..... C10G 1/00; C10B 53/06

[52] U.S. Cl. ..... 208/11 R

[58] Field of Search ..... 208/8 R, 11 R, 11 LE, 208/196; 75/2

[56] References Cited

U.S. PATENT DOCUMENTS

| | | | |
|---|---|---|---|
| 2,609,331 | 9/1952 | Cheney | 208/11 R X |
| 3,656,938 | 4/1972 | Penzes | 75/2 X |
| 3,816,301 | 6/1974 | Sorgenti | 208/196 X |
| 4,108,760 | 8/1978 | Williams et al. | 208/11 R X |
| 4,176,042 | 11/1979 | Fahlström | 208/11 LE |
| 4,177,064 | 12/1979 | Wanzenburg et al. | 208/11 R X |
| 4,214,046 | 7/1980 | Waltrip | 208/8 R X |
| 4,239,613 | 12/1980 | Schulz | 208/8 R X |
| 4,260,471 | 4/1981 | Miller | 208/8 R X |
| 4,269,702 | 6/1981 | Milner et al. | 75/2 X |
| 4,348,274 | 9/1982 | Guerre | 208/11 R X |

*Primary Examiner*—Delbert E. Gantz
*Assistant Examiner*—Glenn A. Caldarola

[57] ABSTRACT

The present invention relates to a process for the substantial reduction of hydrogen sulfide formation during retorting of oil shale by previously treating the oil shale under mild oxidative conditions to passivate the pyrite present in the oil shale. The oxidation of the oil shale under mild oxidative conditions results in the reduction of hydrogen sulfide formation during retorting without a decrease in the amount of oil produced.

12 Claims, No Drawings

PROCESS FOR TREATING OIL SHALE WITH A MILD OXIDANT

This application is related by subject matter to application Ser. No. 490,903, filed May 2, 1983 and now U.S. Pat. No. 4,466,882.

FIELD OF THE INVENTION

The present invention relates to a process for treating oil shale. More specifically, the present invention relates to a process for treating oil shale to reduce hydrogen sulfide formation during retorting.

BACKGROUND OF THE INVENTION

The potential reserves of liquid hydrocarbons contained in subterranean carbonateous deposits are known to be very substantial and form a large portion of the known energy reserves in the world. In fact, the potential reserves of liquid hydrocarbons to be derived from oil shale greatly exceed the known reserves of liquid hydrocarbons to be derived from petroleum. As a result of the increasing demand for light hydrocarbon fractions there is much current interest in economical methods for recovering liquid hydrocarbons from oil shale on commercial scales.

It has long been known that oil may be extracted by heat from various extensive deposits of porous minerals known by their generic term "oil shale", which are permeated by a complex organic material called "kerogen". Upon application of heat, the kerogen is converted to a complex mixture of hydrocarbons and hydrocarbon derivatives which may be recovered from a retort as a liquid shale oil product.

However, many oil shales, particularly the Devonian black shales of the eastern United States, contain large amounts of iron pyrites ($FeS_2$). For example, a New Albany, Bullitt County, Ky. oil shale contains about 6% pyritic sulfur and 12% organic carbon. This pyrite is the cause of at least two serious problems in the winning of oil from the shales. At retorting temperatures, the iron pyrite reacts with the organic matter, generated from kerogen, robbing it of hydrogen, thus resulting in a poorer product and/or a lower yield of oils. Additionally, as a consequence of the foregoing reaction, large quantities of hydrogen sulfide are formed. Because of environmental considerations and due to the corrosive characteristics of hydrogen sulfide, the hydrogen sulfide has to be removed, for example, by converting it to sulfur.

Since the pyrite is uniformly distributed in the shale and the particle size is of the order of about 50 microns, mechanical separation and/or beneficiation to minimize the pyrite concentration are impractical if not impossible.

SUMMARY OF THE INVENTION

Accordingly, it is an objective of this invention to provide a process to attenuate the above problems. Another objective of this invention is to substantially reduce the formation of hydrogen sulfide in the retorting of oil shale which additionally contains pyrite, without reducing the yield of oil.

In accordance with the present invention a process is provided for substantially reducing hydrogen sulfide formation during retorting of oil shale, which additionally contains pyrites, the process comprising the steps of treating the oil shale under mild oxidiative conditions and subsequently retorting the treated shale to recover therefrom hydrocarbon fluids, gases or mixtures thereof.

In accordance with one aspect of the invention a process is provided for substantially reducing hydrogen sulfide formation during retorting of oil shale, which additionally contains pyrites, wherein the oil shale is mixed with an aqueous solution of hydrogen peroxide and the mixture is heated to reflux temperatures. The mixture is allowed to cool down to ambient temperatures and subsequently the oil shale is separated from the aqueous solution. The separated oil shale is retorted to recover therefrom hydrocarbon fluids, gases or mixtures thereof.

DESCRIPTION OF SPECIFIC EMBODIMENTS

In accordance with the present invention, oil shale which contains substantial or detrimental amounts of pyrites, is treated under mild oxidative conditions for a sufficient time to result in a substantial reduction in the amount of hydrogen sulfide produced during subsequent retorting. For example, the shale may be placed in an aqueous medium and oxygen is bubbled through the aqueous medium to result in the mild oxidation of the shale ore. Heat may be applied to the aqueous medium to enhance the oxidation rate. Alternatively, oil shale can be mixed with dilute hydrogen peroxide solutions to achieve mild oxidation. Heat may be applied to increase the rate of oxidation. When hydrogen peroxide is utilized as the oxidant, it is preferred that low concentration be utilized, i.e. 1 to 10% hydrogen peroxide solutions. However, higher concentrations can be utilized when the addition or contact conditions are adjusted to achieve mild oxidation. For instance, a 30% hydrogen peroxide solution may be utilized when such is added dropwise to oil shale in water. It is well within the knowledge of those skilled in the art to control the conditions to achieve mild oxidation. Care should be taken to prevent overoxidation or severe oxidation because such would result in the oxidation of the kerogen in the shale.

To better illustrate the invention a number of experiments were run. About 200 grams of an eastern U.S. oil shale placed in one liter of water were treated dropwise, with successive amounts ($5\times100$ cc) of 30% hydrogen peroxide. The mixture was cooled to room temperature and allowed to settle. The clear liquid was decanted and the mixture was washed with water until the wash water showed the absence of sulfate as indicated by the addition of barium. The wet reaction mixture was filtered and dried in a vacuum at about 130° C. The dry solid was then pelleted and crushed to 16/35 mesh, the standard mesh size used for retorting studies.

Two retorting procedures were followed to assess the degree to which the production of hydrogen sulfide was reduced. In the first procedure, Fischer Assay ASTM D3904 retorting was followed. This is a standard ASTM method and requires the use of a specific retorting vessel, a Fischer retort, and a specific heat-up rate of 12° C./min., from abient temperatures to 500° C. Also, the method specifies maintaining the shale at 500° C. for 40 minutes, plus or minus 5 minutes.

In the second retorting procedure, rapid heat-up Assay (annular retort) procedure was followed. An apparatus, the annular retort, was specially designed and built to achieve a rapid rise in temperature, from ambient to about 400° C. The annular retort is a vessel constructed of two concentric stainless steel tubes with a quarter of an inch annulus. The design allows for a quarter inch thick bed of shale to be packed into the annulus and for heating the shale from the inside and the outside of the annulus when placed in a fluidized sand bath. Retorting in the annular retort followed the standard Fischer Assay ASTM D3904 procedure except that the heat-up rate was 380° C. per minute.

In Example 1 a 100 gram sample of untreated shale, crushed to 16/35 mesh, was retorted according to the Fischer Assay ASTM D3904. In Example 2, a 100 gram sample of treated shale, 16/35 mesh, was retorted as described in Example 1. In Example 3 a 100 gram sample of untreated shale, 16.35 mesh, was retorted in the annular retort using the rapid heat-up Assay procedure. Example 4 relates to the retorting of a 100 gram sample of treated shale, 16/35 mesh, as described in Example 3. The oil, water and hydrogen sulfide yields for Examples 1, 2, 3 and 4 are shown in Table I.

TABLE I

| | Fischer Assay Shale Used | | Rapid Heat-Up Assay Shale Used | |
|---|---|---|---|---|
| | Untreated | Treated | Untreated | Treated |
| Example # | 1 | 2 | 3 | 4 |
| Yield: | | | | |
| Oil, % Wt. | 4.7 | 5.4 | 5.6 | 6.2 |
| Gal/ton | 11.8 | 13.0 | 14.6 | 16.0 |
| Water, % Wt. | 1.3 | 1.2 | 1.3 | 2.0 |
| Hydrogen sulfide, % wt. | 1.2 | 0.1 | 1.4 | 0.2 |

Upon retorting, the peroxide treated shale yields the same amount of oil as the untreated shale, however, the amount of hydrogen sulfide is reduced. As shown in Table I the untreated shale produced 1.2% by weight hydrogen sulfide under Fischer Assay conditions and 1.4% in the rapid heat-up Assay, but the treated shale produced only 0.1% and 0.2% hydrogen sulfide, respectively. In contrast, the oil yields were not reduced. As a matter of fact an increase in the oil yield can be seen in the above experiments. Analysis of oil shale before and after the treatment with the hydrogen peroxide solution under mild oxidative conditions shows that the total sulfur content of the shale was reduced by about 12 percent while in subsequent retorting a 90 percent reduction in hydrogen sulfide formation was observed. It is concluded that the mild oxidative treatment passivates the pyrites in the oil shale in such a manner as to reduce its reactivity during the retorting process.

It is important to note that the oxidation of the shale should be conducted under mild oxidative conditions so as to prevent any substantial oxidation of the kerogen in the oil shale. To demonstrate such, the following example was run. Oil shale was packed in a retort and a mixture of air and steam was passed through the shale. About 30 liters of air were used in the oxidation. That oxidation took place was confirmed by the analysis of the gas leaving the retort. A reduction in oxygen to about 8% was observed for two grab samples. At the conditions of the oxidation chosen, 175° C. and 375 psig, a significant amount of the kerogen was oxidized. This conclusion was based on the results of the retorting step shown in Table II. Retorting produced only 50% as much oil from the air-steam treated sample, as from the untreated oil shale. Hydrogen sulfide formation was also reduced by 50%. The above data seems to clearly indicate that milder oxidation conditions are desirable to achieve the desired pyrite passivation without kerogen oxidation.

TABLE II

| | Untreated Shale | Air/steam Treated Shale |
|---|---|---|
| Yield: | | |
| Oil: wt. % | 4.7 | 2.3 |
| Gal./ton | 11.8 | 5.5 |
| Water: wt. % | 1.3 | 2.4 |
| $H_2S$: wt. % | 1.2 | 0.5 |

Although the present invention has been described with preferred embodiments, it is to be understood that modifications and variations may be resorted to as those skilled in the art will readily understand. Such modifications and variations are considered to be within the purview and scope of the appended claims.

What is claimed is:

1. A process for substantially reducing hydrogen sulfide formation during retorting of oil shale which additionally contains pyrites, comprising the steps of:

(a) treating the oil shale under mild oxidative conditions with sufficient oxidant in an aqueous medium to reduce hydrogen sulfide formation; and (b) retorting the treated shale to recover therefrom hydrocarbon fluids, gases, or mixtures thereof.

2. The process of claim 1 wherein the treatment of the shale under mild oxidative conditions is achieved by treating the shale with a hydrogen peroxide solution prior to retorting.

3. The process of claim 2 wherein the hydrogen peroxide solution is an aqueous solution containing from 1% to 20% hydrogen peroxide.

4. The process of claim 2 wherein heat is applied, to the treatment with the hydrogen peroxide solution, to enhance the rate of mild oxidation.

5. The process of claim 1 wherein mild oxidation is achieved by placing the oil shale in an aqueous medium and bubbling oxygen or an oxygen-containing gas through said aqueous solution an subsequently separating the shale from the aqueous medium prior to retorting.

6. The process of claim 5 wherein the aqueous medium is additionally heated to enhance the rate of mild oxidation.

7. The process of claim 1 wherein the treatment of the oil shale under mild oxidative conditions is carried out under such conditions as to prevent substantial oxidation to kerogen present in the shale.

8. A process for substantially reducing hydrogen sulfide formation during retorting of oil shale which additionally contains pyrites, comprising the steps of:

(a) determining the amount of pyrites present in the shale;

(b) treating the shale under mild oxidative conditions with a hydrogen peroxide solution to oxidize the pyrites; and (c) retorting the treated shale to recover therefrom hydrocarbon fluids, gases or any mixture thereof.

9. The process of claim 8 wherein the hydrogen peroxide solution is an aqueous solution containing from 1% to 20% hydrogen peroxide.

10. The process of claim 8 wherein heat is applied, to the treatment with the hydrogen peroxide solution, to enhance the rate of mild oxidation.

11. The process of claim 8 wherein the treatment of the oil shale under mild oxidative conditions is carried out under such conditions as to prevent substantial oxidation of kerogen present in the shale.

12. A process for substantially reducing hydrogen sulfide formation during retorting of oil shale, which additionally contains pyrites, comprising the steps of:

(a) placing the oil shale in an aqueous medium;

(b) adding oxidant selected from the group consisting of hydrogen peroxide, oxygen, oxygen-containing gas, or any combination thereof under mild oxidative conditions in sufficient amounts to oxidize the pyrites present in the oil shale;

(c) heating the oil shale in the aqueous medium to a temperature sufficient to enhance the rate of oxidation but below that temperatures causing substantial oxidation of kerogen present in the oil shale;

(d) separating the oil shale from the aqueous medium; and (e) retorting the separated oil shale to recover therefrom hydrocarbon fluids, gases or mixtures thereof.

* * * * *

UNITED STATES PATENT AND TRADEMARK OFFICE

CERTIFICATE OF CORRECTION

PATENT NO. : 4,501,651

DATED : February 26, 1985

INVENTOR(S) : Costandi A. Audeh and Joseph J. Dickert, Jr.

It is certified that error appears in the above-identified patent and that said Letters Patent is hereby corrected as shown below:

Patent Column 3, Line 13, "16.35 mesh" should read -- 16/35 mesh --.

Column 6, Claim 12, "temperatures" should read --temperature--.
Line 5

Signed and Sealed this

*Sixteenth* Day of *July 1985*

[SEAL]

*Attest:*

DONALD J. QUIGG

*Attesting Officer* *Acting Commissioner of Patents and Trademarks*